US008061706B2

(12) United States Patent
Freeston

(10) Patent No.: US 8,061,706 B2
(45) Date of Patent: Nov. 22, 2011

(54) METHOD AND APPARATUS FOR ADJUSTING THE HEIGHT OF A MEDIA STACK IN AN IMAGE PRODUCTION DEVICE

(75) Inventor: Ben Freeston, Letchworth Garden City (GB)

(73) Assignee: Xerox Corporation, Norwalk, CT (US)

( * ) Notice: Subject to any disclaimer, the term of this patent is extended or adjusted under 35 U.S.C. 154(b) by 421 days.

(21) Appl. No.: 12/429,203

(22) Filed: Apr. 24, 2009

(65) Prior Publication Data

US 2010/0270733 A1 Oct. 28, 2010

(51) Int. Cl.
*B65H 1/18* (2006.01)

(52) U.S. Cl. ..... 271/152; 271/147

(58) Field of Classification Search ..... 271/147, 271/152

See application file for complete search history.

(56) References Cited

U.S. PATENT DOCUMENTS 6,908,082 B2 * 6/2005 Dobbertin et al. ..... 271/152
7,411,205 B2 * 8/2008 Amarakoon et al. ..... 271/148
7,549,626 B2 * 6/2009 Cook et al. ..... 271/242
7,815,182 B2 * 10/2010 Sciurba et al. ..... 271/9.02
7,913,995 B2 * 3/2011 Clark et al. ..... 271/152
2004/0135307 A1 * 7/2004 Dobbertin et al. ..... 271/152
2006/0208414 A1 * 9/2006 Amarakoon et al. ..... 271/110
2007/0052155 A1 * 3/2007 Cook et al. ..... 271/152
2009/0166950 A1 * 7/2009 Sciurba et al. ..... 271/147

* cited by examiner

*Primary Examiner* — Stefanos Karmis
*Assistant Examiner* — Gerald McClain
(74) *Attorney, Agent, or Firm* — Ronald E. Prass, Jr.; Prass LLP

(57) ABSTRACT

A method and apparatus for adjusting the height of a media stack in an image production device is disclosed. The method may include setting the height of the media stack using a default multiplier, determining if printing has started, wherein if it is determined that printing has started, measuring the thickness of media sheets in the media stack, counting the number of media sheets fed to an image production section of the image production device, determining if the media stack height is below a predetermined threshold using the one or more media stack height sensors, wherein the one or more media stack height sensors determine that the media stack height is below the predetermined threshold, calculating a next multiplier using the measured paper thickness and counted number of sheets fed, and setting the next media stack height using the calculated next multiplier.

18 Claims, 5 Drawing Sheets

METHOD AND APPARATUS FOR ADJUSTING THE HEIGHT OF A MEDIA STACK IN AN IMAGE PRODUCTION DEVICE

BACKGROUND

Disclosed herein is a method for adjusting the height of a media stack in an image production device, as well as corresponding apparatus and computer-readable medium.

In conventional image production devices, adjustment of media stack feeding paper used to produce images is inaccurate and excessive. In particular, when stiffer material is fed through the device, the current processes often produce multi-feeds or miss-feeds that may lead to damage to the retard roll.

SUMMARY

A method and apparatus for adjusting the height of a media stack in an image production device is disclosed. The method may include setting the height of the media stack using a default multiplier, determining if printing has started, wherein if it is determined that printing has started, measuring the thickness of media sheets in the media stack, counting the number of media sheets fed to an image production section of the image production device, determining if the media stack height is below a predetermined threshold using the one or more media stack height sensors, wherein the one or more media stack height sensors determine that the media stack height is below the predetermined threshold, calculating a next multiplier using the measured paper thickness and counted number of sheets fed, and setting the next media stack height using the calculated next multiplier.

DETAILED DESCRIPTION

Figure 1:
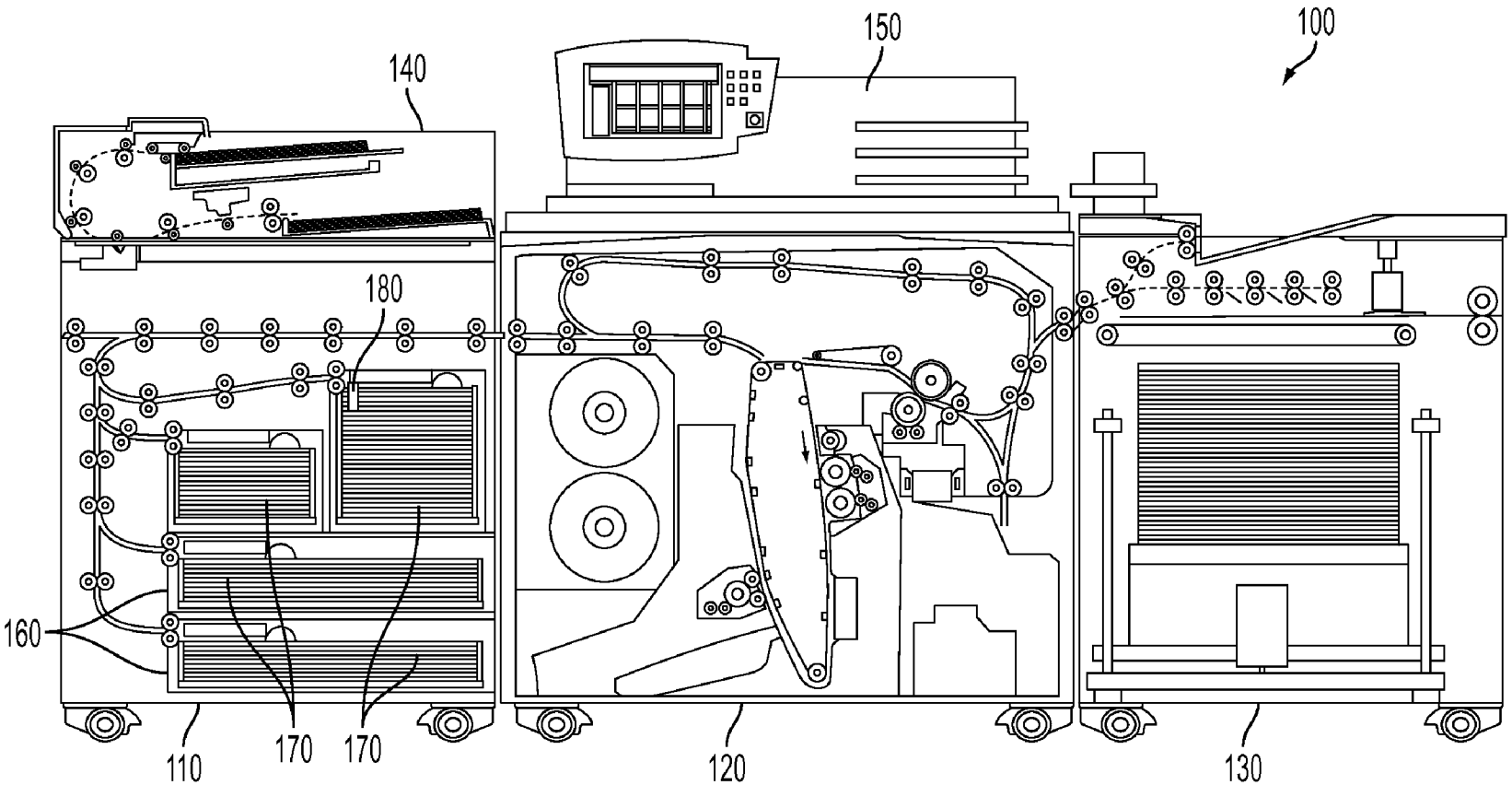
FIG. 1 is an exemplary diagram of an image production device in accordance with one possible embodiment of the disclosure.

Aspects of the embodiments disclosed herein relate to a method for adjusting the height of a media stack in an image production device, as well as corresponding apparatus and computer-readable medium.

The disclosed embodiments may include a method for adjusting the height of a media stack in an image production device is disclosed. The method may include setting the height of the media stack using a default multiplier, determining if printing has started, wherein if it is determined that printing has started, measuring the thickness of media sheets in the media stack, counting the number of media sheets fed to an image production section of the image production device, determining if the media stack height is below a predetermined threshold using the one or more media stack height sensors, wherein the one or more media stack height sensors determine that the media stack height is below the predetermined threshold, calculating a next multiplier using the measured paper thickness and counted number of sheets fed, setting the next media stack height using the calculated next multiplier, determining if the print job has ended, wherein if it is determined that the print job has ended, ceasing measurement of the paper thickness and counting of the number of sheets fed.

The disclosed embodiments may further include an image production device that may include one or more media height sensors that detect the height of a media stack, a media elevator control unit that controls movement of the media elevator to set the height of the media stack, and a media stack adjustment module that signals the media elevator control unit to set the height of the media stack using a default multiplier, determines if printing has started, wherein if the media stack adjustment module determines that printing has started, the media stack adjustment module measures the thickness of the media sheets in the media stack and counts the number of media sheets fed to an image production section of the image production device, determines if media stack height is below a predetermined threshold based on input from the one or more media stack height sensors, wherein if the media stack adjustment module determines that media stack height is below a predetermined threshold, the media stack adjustment module calculates a next multiplier using the measured paper thickness and counted number of sheets fed, signals the media elevator control unit to set the next media stack height using the calculated next multiplier, determines if the print job has ended, wherein if the media stack adjustment module determines that the print job has ended, the media stack adjustment module ceases measurement of the paper thickness and counting of the number of sheets fed.

The disclosed embodiments may further include a computer-readable medium storing instructions for controlling a computing device for adjusting the height of a media stack in an image production device. The instructions may include setting the height of the media stack using a default multiplier, determining if printing has started, wherein if it is determined that printing has started, measuring the thickness of media sheets in the media stack, counting the number of media sheets fed to an image production section of the image production device, determining if the media stack height is below a predetermined threshold using the one or more media stack height sensors, wherein the one or more media stack height sensors determine that the media stack height is below the predetermined threshold, calculating a next multiplier using the measured paper thickness and counted number of sheets fed, setting the next media stack height using the calculated next multiplier, determining if the print job has ended, wherein if it is determined that the print job has ended, ceasing measurement of the paper thickness and counting of the number of sheets fed.

The disclosed embodiments may concern a method and apparatus for adjusting the height of a media stack in an image production device. The process may include using a media sheet thickness measurement and fed media sheet count to calculate the previous distance adjusted and apply a multiplier to correct a target adjustment value (e.g., 1.1 mm for some machines but may be a different value for others). Each subsequent adjustment may be calculated from the previous adjustment which may maintain the adjusted distance regardless of media type and media tray fill level.

In image production devices, as media sheets are fed from a media stack, the media stack needs to be maintained at an optimum height to avoid malfunctions. As such, after one or more sensor detects that the media stack height has dropped below a predetermined threshold, (such as every 1.1 mm, for example), the media stack may need to be lifted by a calculated distance to ensure proper feeding of the media sheets to an image production section of the image production device.

This process remedies problems occurring in conventional image production devices. In particular, in conventional image production devices, there are at least three problems with adjustments to the media stack height:

1) The current equation used to calculate the media stack height adjustment or lift distance does not produce consistent adjustment distances as the media tray empties. This issue may occur because there is an element of "over run" (or extra lift) where the flex in the tray causes the media stack to continue lifting after the media elevator motor has stopped. This problem is made worse when the force on the lifting mechanism of the media elevator is increased. As such, full media stacks may cause more over run and the type, size and orientation of the media in the tray also may enhance this effect.

2) There may also be a "loss of lift" experienced such that when the media stack is determined to be low and begins to rise, then slows, and then continues to rise. This issue causes a reduction in total lift distance and further increases the difference in lift height between a full stack and low stack because the heavy stack over lifts and the low stack under lifts.

3) The adjustment distance may also be generally be much higher than the recommended distance (e.g., 1.1 mm for some devices) so that the media sheet being fed does not come into contact with the retard shield that helps separate the sheets and as a result, travels over it which causes miss-feeds, multi-feeds and damage to the retard roll.

To counter act the problems in conventional image production devices, the disclosed embodiments concern making media stack height adjustments by using a multiplier that uses the measured paper thickness and the number of media sheets fed since the last adjustment to calculate the adjustment distance. The process counts the media sheets fed until a media stack height sensor triggers a low stack signal. The process then multiplies the number of media sheets fed by the media sheet thickness to get the distance which the media stack was above the sensor after the previous media stack height adjustment. Using this information, a multiplier is calculated based on the target distance which will increase or decrease the next media stack height adjustment distance. This adjustment distance will then be measured and the process repeated. Only the first lift of the tray is uncalculated and a default multiplier is used to ensure the process does not exceed the target adjustment value.

Thus, the next multiplier (M) for next media stack height adjustment may be:

$$M = \frac{T}{((RS)/P)}$$

where T=Target adjustment distance

R=Measured paper thickness

S=Number of media sheets fed since last adjustment

P=Previous multiplier used for media stack height adjustment

Thus, using the next multiplier, an example adjustment may be shown as:

Adjustment (mm)=((0.075*e^(0.04*X)*(0.0055*X)+1.1)*M where the adjustment uses the equation ((0.075*e^(0.04*X)*(0.0055*X))+1.1), X is the current tray height (mm) and M is the next multiplier.

In conventional image production devices, there is no system to correct media stack adjustments that takes into account the fill level of tray, paper type, paper size or paper orientation. The advantages of a processed described in the disclose embodiments are that:

- This process may not require any information to be provided by the customer.
- The process may work for any paper type or size without the customer or the image production device needing to know what is being fed.
- The process may maintain the target media stack height distance as the tray empties.
- The process may work (or be easily adapted) for any future designs or products (assuming paper thickness is measured).

FIG. 1 is an exemplary diagram of an image production device 100 in accordance with one possible embodiment of the disclosure. The image production device 100 may be any device that may be capable of making image production documents (e.g., printed documents, copies, etc.) including a copier, a printer, a facsimile device, and a multi-function device (MFD), for example.

The image production device 100 may include an image production section 120, which may include hardware by which image signals are used to create a desired image, as well as a feeder section 110, which stores and dispenses sheets on which images are to be printed, and an output section 130, which may include hardware for stacking, folding, stapling, binding, etc., prints which are output from the marking engine. If the image production device 100 is also operable as a copier, the printer further includes a document feeder 140, which operates to convert signals from light reflected from original hard-copy image into digital signals, which are in turn processed to create copies with the image production section 120. The image production device 100 may also include a local user interface 150 for controlling its operations, although another source of image data and instructions may include any number of computers to which the printer is connected via a network.

The feeder section 110 may include any number of trays 160, each of which stores a media stack 170 or print sheets ("media") of a predetermined type (size, weight, color, coating, transparency, etc.) and includes a feeder to dispense one of the sheets therein as instructed. Certain types of media may require special handling in order to be dispensed properly. For example, heavier or larger media may desirably be drawn from a media stack 170 by use of an air knife, fluffer, vacuum grip or other application of air pressure toward the top sheet or sheets in a media stack 170.

Media stack height sensor 180 may represent or include one or more contact or non-contact sensors that may detect the position of the media stack 170 (and may also serve to detect the thickness of media sheets), such as one or more linear-optical sensor, a charge-coupled device sensor, or a Complementary Metal Oxide Semiconductor (CMOS) sensor. The one or more media stack height sensors 180 may detect the position of the media stack 170 continuously or after each media sheet is fed for processing, for example.

The media sheets drawn from the media stack 170 on a selected tray 160 may then be moved to the image production section 120 to receive one or more images thereon. Then, the printed sheet is then moved to output section 130, where it may be collated, stapled, folded, etc., with other media sheets in manners familiar in the art.

Figure 2:
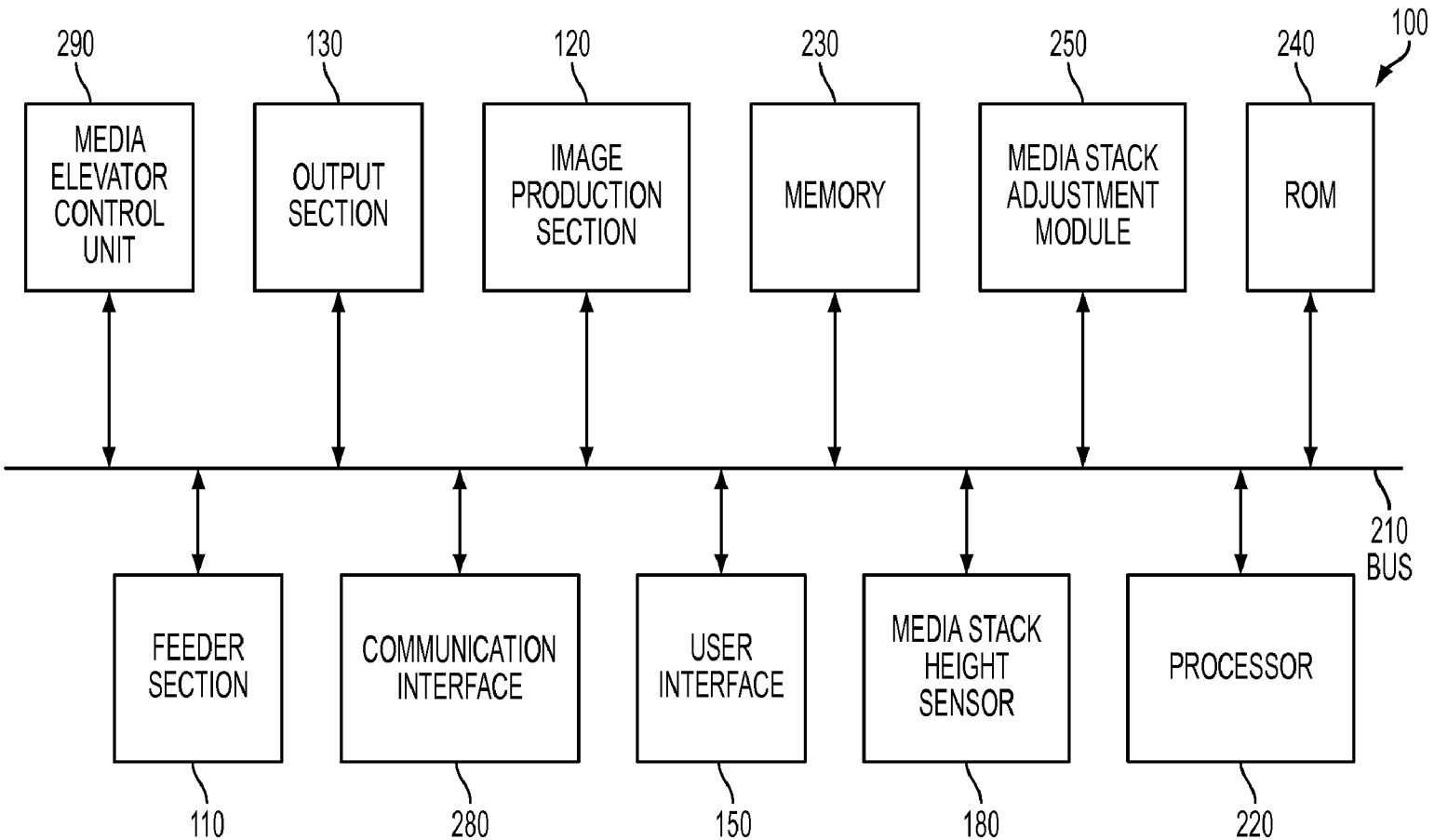
FIG. 2 is an exemplary block diagram of the image production device in accordance with one possible embodiment of the disclosure.

FIG. 2 is an exemplary block diagram of the image production device 100 in accordance with one possible embodiment of the disclosure. The image production device 100 may include a bus 210, a processor 220, a memory 230, a read only memory (ROM) 240, a media stack adjustment module 250, a feeder section 110, an output section 130, a user interface 150, a communication interface 280, an image production section 120, one or more media stack height sensor 180, and a media elevator control unit 290. Bus 210 may permit communication among the components of the image production device 100.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

As stated above, user interface 150 may include one or more conventional mechanisms that permit a user to input information to and interact with the image production unit 100, such as a keyboard, a display, a mouse, a pen, a voice recognition device, touchpad, buttons, etc., for example. Output section 130 may include one or more conventional mechanisms that output image production documents to the user, including output trays, output paths, finishing section, etc., for example. The image production section 120 may include an image printing and/or copying section, a scanner, a fuser, a spreader, etc., for example.

The image production device 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The image production device 100 illustrated in FIGS. 1-2 and the related discussion are intended to provide a brief, general description of a suitable communication and processing environment in which the disclosure may be implemented. Although not required, the disclosure will be described, at least in part, in the general context of computer-executable instructions, such as program modules, being executed by the image production device 100, such as a communication server, communications switch, communications router, or general purpose computer, for example.

Generally, program modules include routine programs, objects, components, data structures, etc. that perform particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like.

The operation of the media stack adjustment module 250, the one or more media stack height sensor 180, and the media elevator control unit 290 will be discussed in relation to the block diagram in FIG. 3 and the flowchart in FIG. 5.

Figure 3:
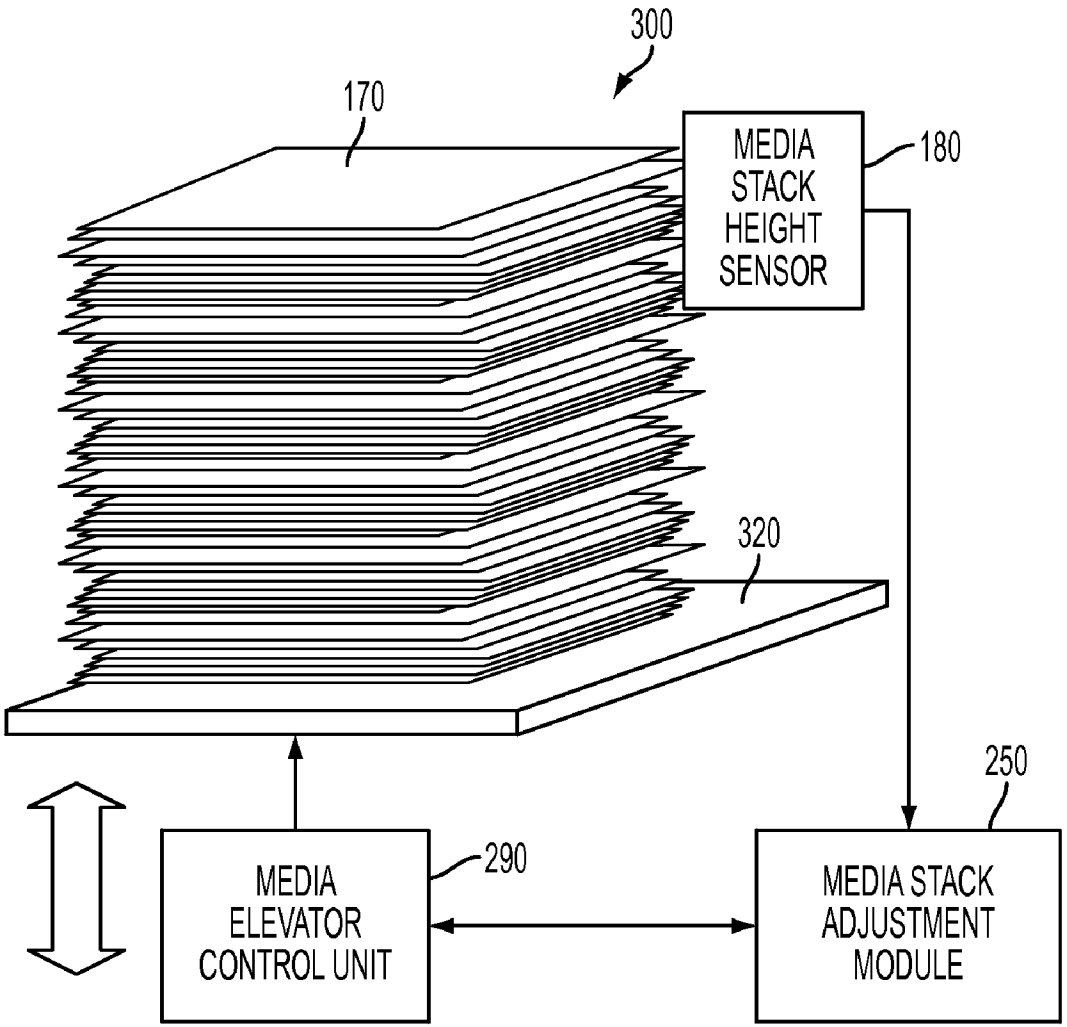
FIG. 3 is an exemplary diagram of a media stack adjustment environment in the image production device in accordance with one possible embodiment of the disclosure.

FIG. 3 is an exemplary diagram of a non-contact media stack measurement environment 300 in the image production device in accordance with one possible embodiment of the disclosure. The media stack adjustment environment 300 (at in part) may be found in the feeder section 110 and may include media elevator control unit 310, media elevator 320, one or more media stack height sensors 180, and the media stack adjustment module 250.

While the term media stack 170 is used for ease of discussion, the media stack 170 may represent any type of media sheets used to produce documents in the image production device 100, such as any type of paper, plastic, photo paper, cardboard, etc. In addition, for ease of discussion, the term media stack 170 may represent an entire media stack or a portion of a media stack, for example.

As shown, as media sheets are being fed, the one or more media stack height sensors 180 may provide signals concerning the height (or position) of media sheets in the media stack 170 to the media stack adjustment module 250. Then, based on the media stack height sensor 180 input, the media stack adjustment module 250 may then provide input to the media elevator control unit 310 to change the height of the media elevator 320.

During the process, as media sheets are being fed to the image production section 120 for image processing, the media stack 170 decreases in size. As this decrease is detected by the media stack height sensor 180 (as discussed below), the media elevator 320 must be raised by the media elevator control unit 310 by a media stack adjustment to provide the optimal media stack height to prevent jamming and provide the fastest and most efficient media sheet feed possible. The further details of the media stack adjustment process will be described in relation to the flowchart in FIG. 5, for example.

Note that in some embodiments, the media stack height sensor 180 may also provide input to the media stack adjustment module 250 or a fluffer controller (not shown) to increase or decrease the air flow to a fluffer depending on factors such as the type media, environmental conditions (e.g., temperature and/or humidity), etc.

Figure 4:
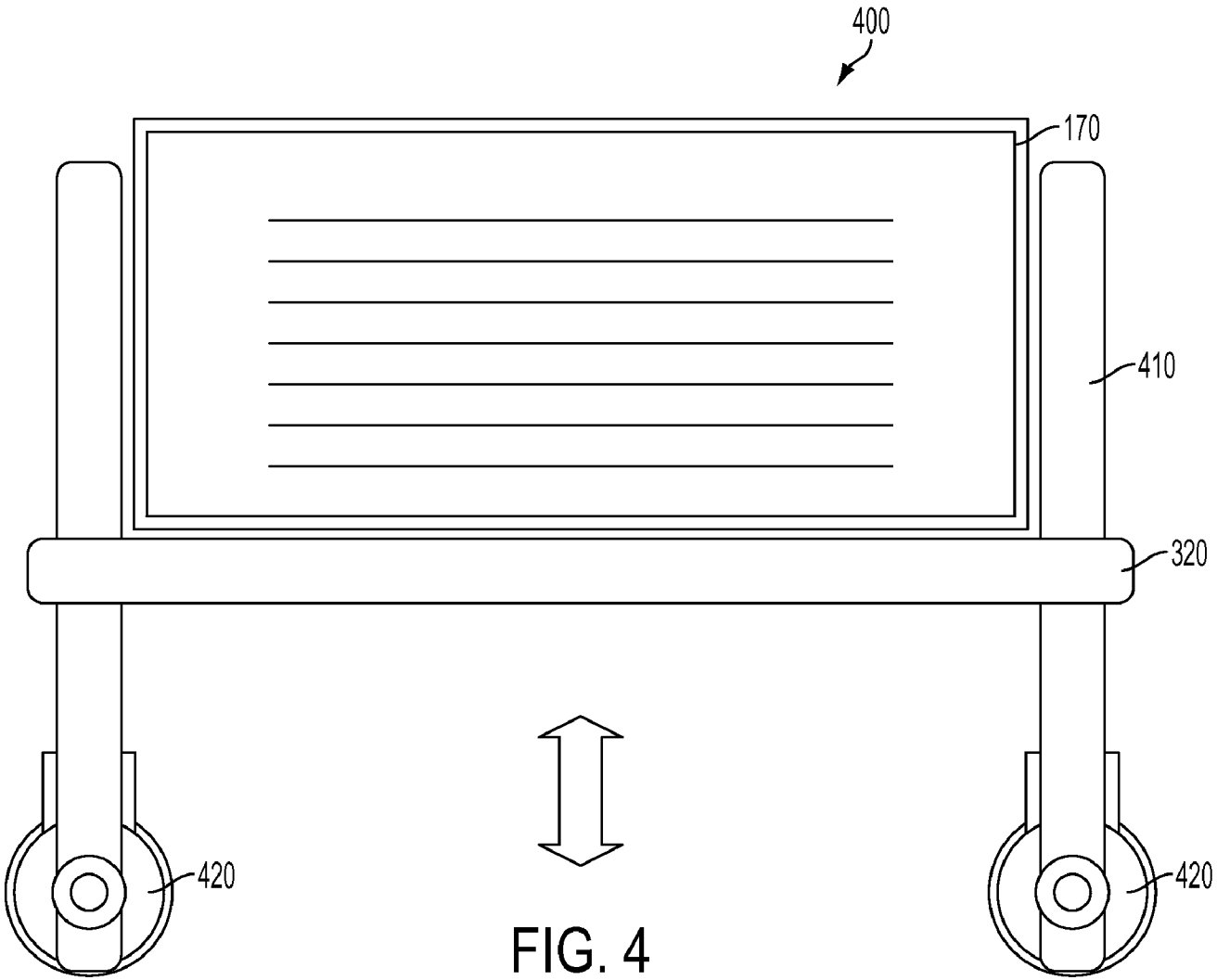
FIG. 4 is an exemplary diagram of a possible media elevator unit in accordance with one possible embodiment of the disclosure.

FIG. 4 is an exemplary diagram of a possible media elevator unit 400 in accordance with one possible embodiment of the disclosure. The media elevator unit 400 may include a media elevator 320 that may be adjusted by the media elevator control unit 310 in order to accommodate the characteristics of various sheet types and media quantity conditions of the media stack 170. The media elevator unit 400 may also includes multiple tray elevator slots 410 and elevator drives 420 for raising or lowering the media elevator 320 holding the media stack 170. Note that this type of media elevator unit 400 is shown for illustrative purposes only. The disclosed embodiments may be applied to any media elevator type in any image production device 100.

Figure 5:
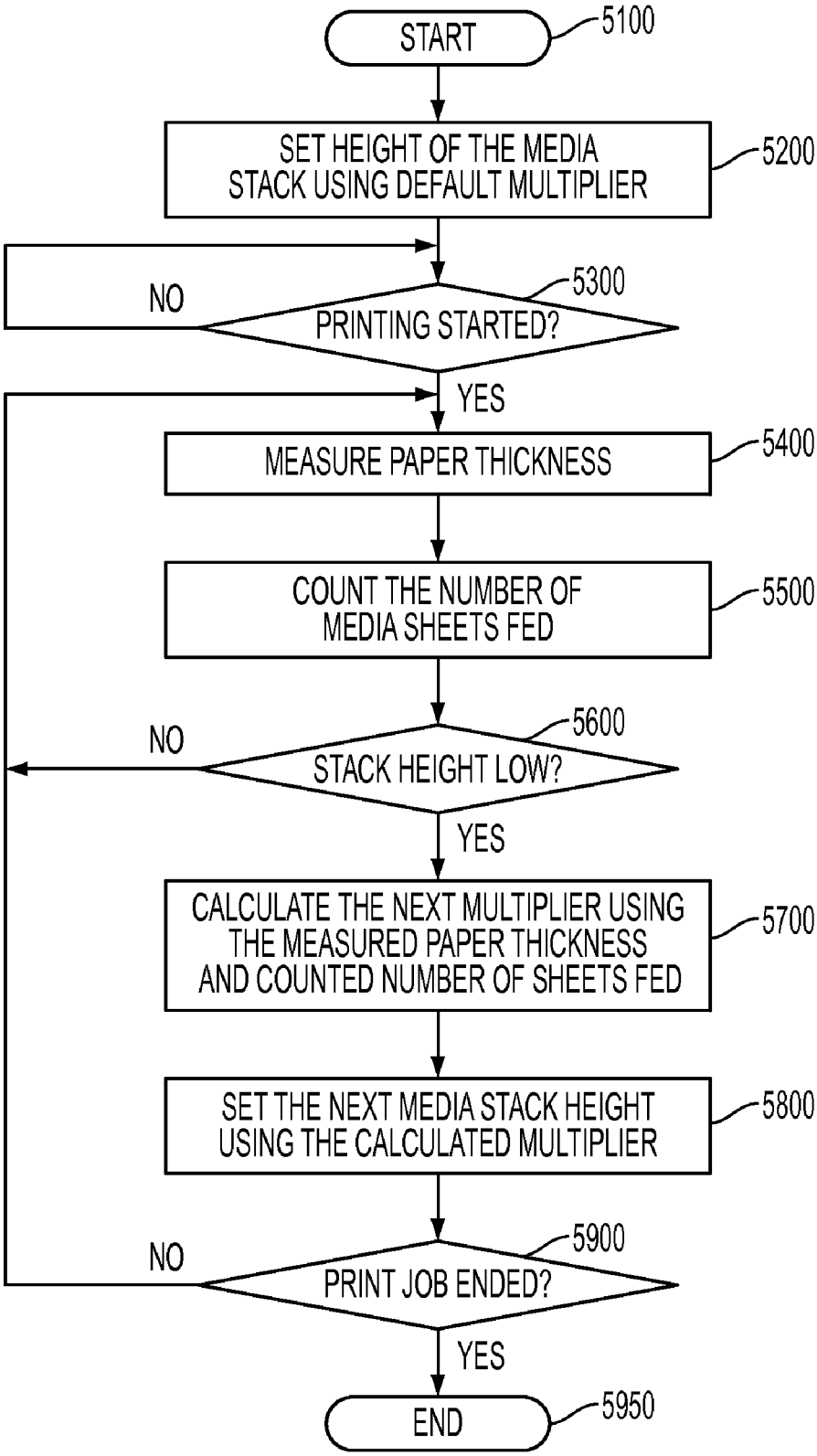
FIG. 5 is a flowchart of an exemplary non-contact media stack measurement process in accordance with one possible embodiment of the disclosure.

FIG. 5 is a flowchart of a fluffer environmental control process in accordance with one possible embodiment of the disclosure. The process begins at step 5100, and continues to step 5200 where the media stack adjustment module 250 may signal the media elevator control unit 290 to set the height of the media stack 170 using a default multiplier. The default multiplier may be provided during manufacture, set-up, user input, or programming of the image production device 100, for example. As an example, the default multiplier may be approximately 0.71 in some image production devices 100. At step 5300, the media stack adjustment module 250 may determine if printing has started. If the media stack adjustment module 250 determines that printing has not started, the process may return to step 5300.

However, if the media stack adjustment module 250 determines that printing has started, at step 5400, the media stack adjustment module 250 may measure the thickness of the media sheets in the media stack 170. The media stack adjustment module may measure the media sheet thickness using a media sheet transfer mechanism such as through a nip that may include a pressure roll. The media stack adjustment module 250 may measure the media sheet thickness within the first three fed media sheets, for example.

At step 5500, the media stack adjustment module 250 may count the number of media sheets fed to an image production section 120 of the image production device 100. At step 5600, the media stack adjustment module 250 may determine if media stack height is below a predetermined threshold based on input from the one or more media stack height sensors 180. If the media stack adjustment module 250 determines that media stack height is below not the predetermined threshold, the process may return to step 5400.

However, if the media stack adjustment module 250 determines that media stack height is below the predetermined threshold, at step 5700, the media stack adjustment module 250 may calculate the next multiplier using the measured paper thickness and counted number of sheets fed. In this process, the media stack adjustment module 250 may calculate the next multiplier (M) for the next media stack height adjustment according to the formula:

$$M = \frac{T}{((RS)/P)}$$

where T=Target adjustment distance
R=Measured paper thickness
S=Number of media sheets fed since last adjustment
P=Previous multiplier used for media stack height adjustment For some image production devices 100, the target adjustment distance may be approximately 1.1 mm, for example.

At step 5800, the media stack adjustment module 250 may signal the media elevator control setting unit 290 to set the next media stack height using the calculated next multiplier. At step 5900, the media stack adjustment module 250 may determine if the print job has ended. If the media stack adjustment module 250 determines that the print job has not ended, the process may return to step 5400. However, if the media stack adjustment module 250 determines that the print job has ended, the media stack adjustment module 250 may cease measurement of the paper thickness and counting of the number of sheets fed and the process may then go to step 5950 and end.

Note that even though media sheet counting has stopped for a particular print job, after the job has finished, the count of the media sheets fed since the previous adjustment may be maintained and may be stored in memory 230, for example, and used for the beginning of the next print job. The count may be maintained after a print job is complete because the media sheet count represents the distance the stack was lifted at the last adjustment. The count value of sheets fed previously may be retained until the tray is opened and closed to keep the tray lifts consistent.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard wired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for adjusting the height of a media stack in an image production device, comprising:

setting the height of the media stack using a default multiplier;

determining if printing has started, wherein if it is determined that printing has started, measuring the thickness of media sheets in the media stack;

counting the number of media sheets fed to an image production section of the image production device;

determining if the media stack height is below a predetermined threshold using the one or more media stack height sensors, wherein the one or more media stack height sensors determine that the media stack height is below the predetermined threshold, calculating a next multiplier using the measured paper thickness and counted number of sheets fed;

setting the next media stack height using the calculated next multiplier;

determining if the print job has ended, wherein if it is determined that the print job has ended, ceasing measurement of the paper thickness and counting of the number of sheets fed;

wherein the next multiplier (M) for the next media stack height adjustment is calculated according to the formula:

$$M = \frac{T}{((RS)/P)}$$

where T=Target adjustment distance

R=Measured paper thickness

S=Number of media sheets fed since last adjustment

P=Previous multiplier used for media stack height adjustment.

2. The method of claim 1, wherein the media sheet thickness is measured using a media sheet transfer mechanism, the media sheet transfer mechanism including a pressure roll.

3. The method of claim 2, wherein the media sheet thickness is measured within the first three fed media sheets.

4. The method of claim 1, wherein the one or more media stack height sensors are at least one of a linear-optical sensor, a charge-coupled device sensor, and a Complementary Metal Oxide Semiconductor sensor.

5. The method of claim 1, wherein the image production device is one of a copier, a printer, a facsimile device, and a multi-function device.

6. The method of claim 1, wherein the target adjustment distance is approximately 1.1 mm.

7. An image production device, comprising:

one or more media height sensors that detect the height of a media stack;

a media elevator control unit that controls movement of the media elevator to set the height of the media stack; and a media stack adjustment module that signals the media elevator control unit to set the height of the media stack using a default multiplier, determines if printing has started, wherein if the media stack adjustment module determines that printing has started, the media stack adjustment module measures the thickness of the media sheets in the media stack and counts the number of media sheets fed to an image production section of the image production device, determines if media stack height is below a predetermined threshold based on input from the one or more media stack height sensors, wherein if the media stack adjustment module determines that media stack height is below a predetermined threshold, the media stack adjustment module calculates a next multiplier using the measured paper thickness and counted number of sheets fed, signals the media elevator control setting unit to set the next media stack height using the calculated next multiplier, determines if the print job has ended, wherein if the media stack adjustment module determines that the print job has ended, the media stack adjustment module ceases measurement of the paper thickness and counting of the number of sheets fed;

wherein the next multiplier (M) for the next media stack height adjustment is calculated according to the formula:

$$M = \frac{T}{((RS)/P)}$$

where T=Target adjustment distance

R=Measured paper thickness

S=Number of media sheets fed since last adjustment

P=Previous multiplier used for media stack height adjustment.

8. The image production device of claim 7, wherein the image production device is one of a copier, a printer, a facsimile device, and a multi-function device.

9. The image production device of claim 7, wherein the media stack adjustment module measures the media sheet thickness using a media sheet transfer mechanism, the media sheet transfer mechanism including a pressure roll.

10. The image production device of claim 9, wherein the media stack adjustment module measures the media sheet thickness within the first three fed media sheets.

11. The image production device of claim 7, wherein the one or more media stack height sensors are at least one of a linear-optical sensor, a charge-coupled device sensor, and a Complementary Metal Oxide Semiconductor sensor.

12. The image production device of claim 7, wherein the target adjustment distance is approximately 1.1 mm.

13. A computer-readable medium storing instructions for controlling a computing device for adjusting the height of a media stack in an image production device, the instructions comprising:

setting the height of the media stack using a default multiplier;

determining if printing has started, wherein if it is determined that printing has started, measuring the thickness of the media sheets in the media stack;

counting the number of media sheets fed to an image production section of the image production device;

determining if the media stack height is below a predetermined threshold using the one or more media stack height sensors, wherein the one or more media stack height sensors determine that the media stack height is below the predetermined threshold, calculating a next multiplier using the measured paper thickness and counted number of sheets fed;

setting the next media stack height using the calculated next multiplier;

determining if the print job has ended, wherein if it is determined that the print job has ended, ceasing measurement of the paper thickness and counting of the number of sheets fed;

wherein the next multiplier (M) for the next media stack height adjustment is calculated according to the formula:

$$M = \frac{T}{((RS)/P)}$$

where T=Target adjustment distance

R=Measured paper thickness

S=Number of media sheets fed since last adjustment

P=Previous multiplier used for media stack height adjustment.

14. The computer-readable medium of claim 13, wherein the target adjustment distance is approximately 1.1 mm.

15. The computer-readable medium of claim 13, wherein the image production device is one of a copier, a printer, a facsimile device, and a multi-function device.

16. The computer-readable medium of claim 13, wherein the media sheet thickness is measured using a media sheet transfer mechanism, the media sheet transfer mechanism including a pressure roll.

17. The computer-readable medium of claim 16, wherein the media sheet thickness is measured within the first three fed media sheets.

18. The computer-readable medium of claim 13, wherein the one or more media stack height sensors are at least one of a linear-optical sensor, a charge-coupled device sensor, and a Complementary Metal Oxide Semiconductor sensor.

* * * * *